US006325374B1

(12) United States Patent
Burger et al.

(10) Patent No.: US 6,325,374 B1
(45) Date of Patent: Dec. 4, 2001

(54) EDUCATIONAL BOARD GAME METHOD AND APPARATUS

(76) Inventors: Eric A. Burger; Kathleen A. Burger, both of 856 E. 167 Ct., Gardner, KS (US) 66030

( * ) Notice: Subject to any disclaimer, the term of this patent is extended or adjusted under 35 U.S.C. 154(b) by 0 days.

(21) Appl. No.: 09/522,121

(22) Filed: Mar. 9, 2000

(51) Int. Cl.[7] ..... A63F 3/00
(52) U.S. Cl. ..... 273/271; 273/236; 273/264
(58) Field of Search ..... 273/236, 242, 273/248, 271, 264, 243

(56) References Cited

U.S. PATENT DOCUMENTS

| | | |
|---|---|---|
| 5,029,871 | 7/1991 | Willson, Jr. et al. . |
| 5,332,229 | 7/1994 | Fielder et al. . |
| 5,377,992 | 1/1995 | Audet . |
| 5,601,288 | 2/1997 | White et al. . |

*Primary Examiner*—Benjamin H. Layno
*Assistant Examiner*—V K Mendiratta
(74) *Attorney, Agent, or Firm*—Dale J. Ream

(57) ABSTRACT

A method and apparatus for playing a board game comprises a rectangular game board having one hundred rectangular spaces of equal dimension, two each of the spaces having color and pictorial indicia different than color and pictorial indicia of any other two spaces. The board game further includes a first and second deck of cards having identical cards, each card having first and second indicia associated with the color and pictorial indicia of two spaces of the game board. The indicia of the cards is not identical to that of the spaces and requires an associative mental step to correspond a card with a respective space. The board game further includes tokens for positioning upon a space associated with a selected card. The method of play includes shuffling cards from the two decks into a single deck, distributing a predetermined number of cards to game players, and dividing the combined deck into two decks. In sequence, players discard a card, place a token upon a space associated with the discarded card, and draw a replacement card. Failure to draw a replacement card before the next player discards a card results in forfeiture of the opportunity to draw. Play continues until a player or player team positions a predetermined number of tokens on adjacent horizontal, vertical, or diagonal spaces including wild spaces. Predetermined wild cards and special wild cards allow a player to place a token on any space or to remove another player's token from a space, respectively.

9 Claims, 4 Drawing Sheets

EDUCATIONAL BOARD GAME METHOD AND APPARATUS

BACKGROUND OF THE INVENTION

This invention relates generally to board games and, more particularly, to a board game involving the placement of tokens on spaces of a game board associated with indicia on selected playing cards.

Various board games utilizing playing cards and tokens for placement upon spaces of a game board have been proposed in the art, such as in U.S. Pat. Nos. 5,029,871, 5,377,992, 5,332,229, and 5,601,288. While assumably effective for their intended purposes, each of these board games lack an educational element for making the game beneficial both to young children and adults.

Therefore, it is desirable to have a board game which includes a game board divided into a plurality of spaces bearing at least two types of indicia. It is further desirable to have a board game which includes a plurality of cards with at least two types of indicia associated with the indicia of the game board spaces. Finally, it is desirable to have a method of playing a board game in which tokens are positioned upon spaces of the game board according to the mental association of indicia on selected cards with indicia on the game board spaces.

SUMMARY OF THE INVENTION

A board game according to the preferred embodiment of the present invention includes a rectangular game board having one hundred rectangular spaces of equal dimension, two each of the spaces having a combination of color and pictorial indicia different than a combination of color and pictorial indicia of any other two spaces. The board game further includes two decks of game cards with the cards of the second deck being identical to the cards of the first deck. Each card includes a combination of color and alphabetical indicia associated with the combination of indicia of two spaces on the game board. For example, a card may present the word "horse" on a blue background. A child learning to read and identify colors would be required to associate both the word "horse" and the color blue with a game board space presenting a picture of a horse on a blue background. In a simpler embodiment, a card may present a picture of a horse on a blue background, merely requiring the child to match both the color and picture with the correct space. The types and content of indicia of the spaces and cards may vary according to desired target users.

The board game further includes a plurality of tokens for placement upon spaces having indicia associated with the indicia of particular cards. Each token includes a disk-like configuration having radial rim surfaces about top and bottom sides thereof. Each rim surface includes a plurality of flange/notch combinations for stacking tokens atop one another. Different colored tokens may be provided or top and bottom sides of each token may present different colors.

The method of game play according to the preferred embodiment of the present invention involves shuffling the two decks of cards into a single deck and distributing five cards to each player. Although a plurality of players may play the game together, the players are divided into two teams with each team having its own distinct set of tokens. In sequence, each player discards a card and places a token on the game board space associated with indicia on the card. This step requires the player to mentally associate the combination of indicia on the particular card with the combination of indicia of a corresponding space. Particular cards are designated as wild cards or special wild cards allowing a player to position a token on any desired space or to remove another player's previously positioned token, respectively. Play continues until a player or player team positions his tokens on two series of five adjacent horizontal, vertical, or diagonal spaces.

Therefore, it is a general object of this invention to provide a board game and method of play which involves placing tokens on a game board by associating indicia of a selected card with indicia of a corresponding space.

Another object of the present invention is to provide a board game and method of play, as aforesaid, which involves associating a combination of indicia of a card with a combination of indicia of a corresponding game board space.

Still another object of the present invention is to provide a board game and method of play, as aforesaid, which includes stackable tokens.

Yet another object of the present invention is to provide a board game and method of play, as aforesaid, which is both entertaining and educational.

A further object of the present invention is to provide a board game and method of play, as aforesaid, which requires a predetermined number of a player's tokens to be positioned on adjacent spaces to be declared the winner.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
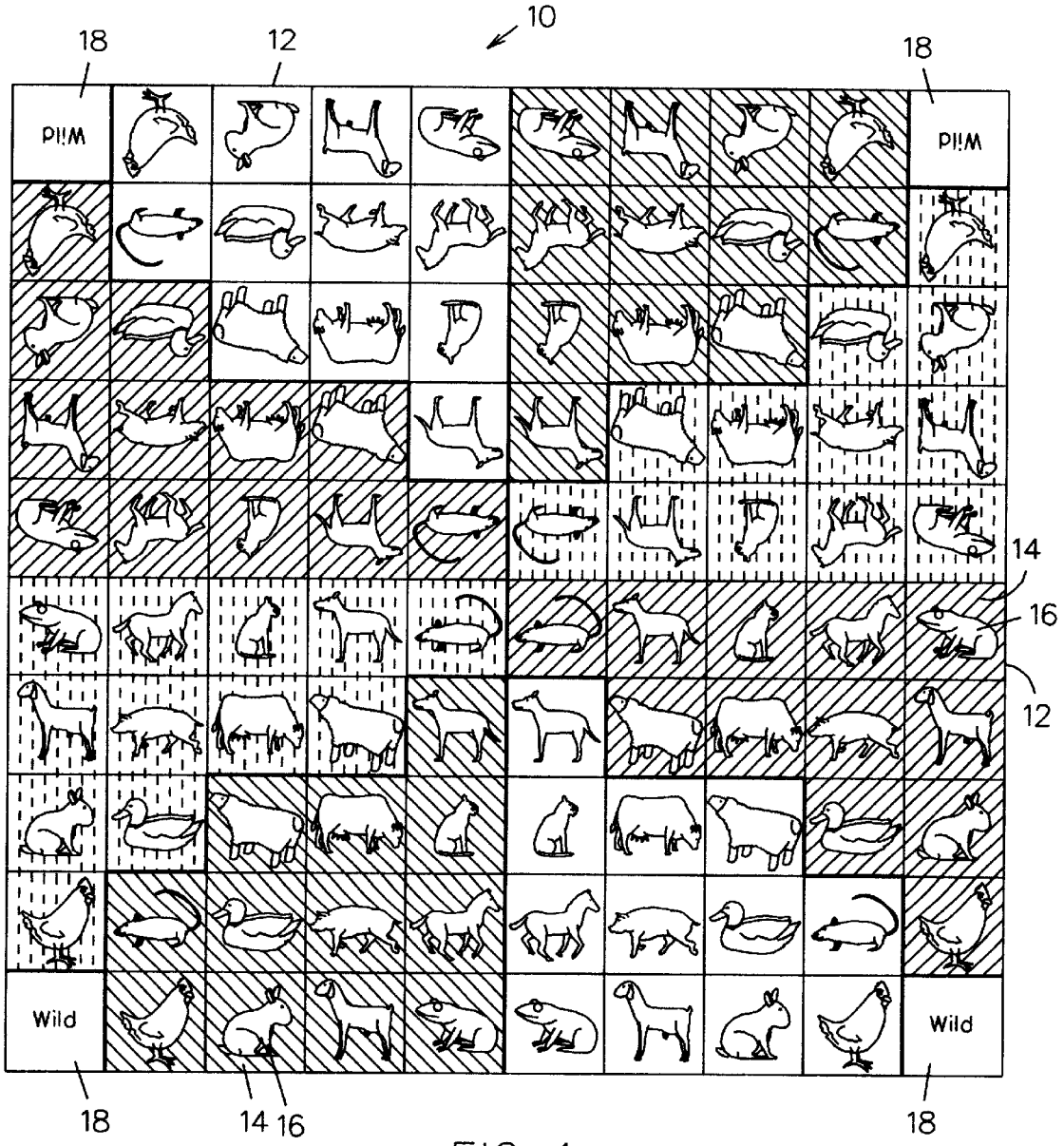
FIG. 1 is a top view of the game board according to the preferred embodiment of the present invention.
Figure 2:
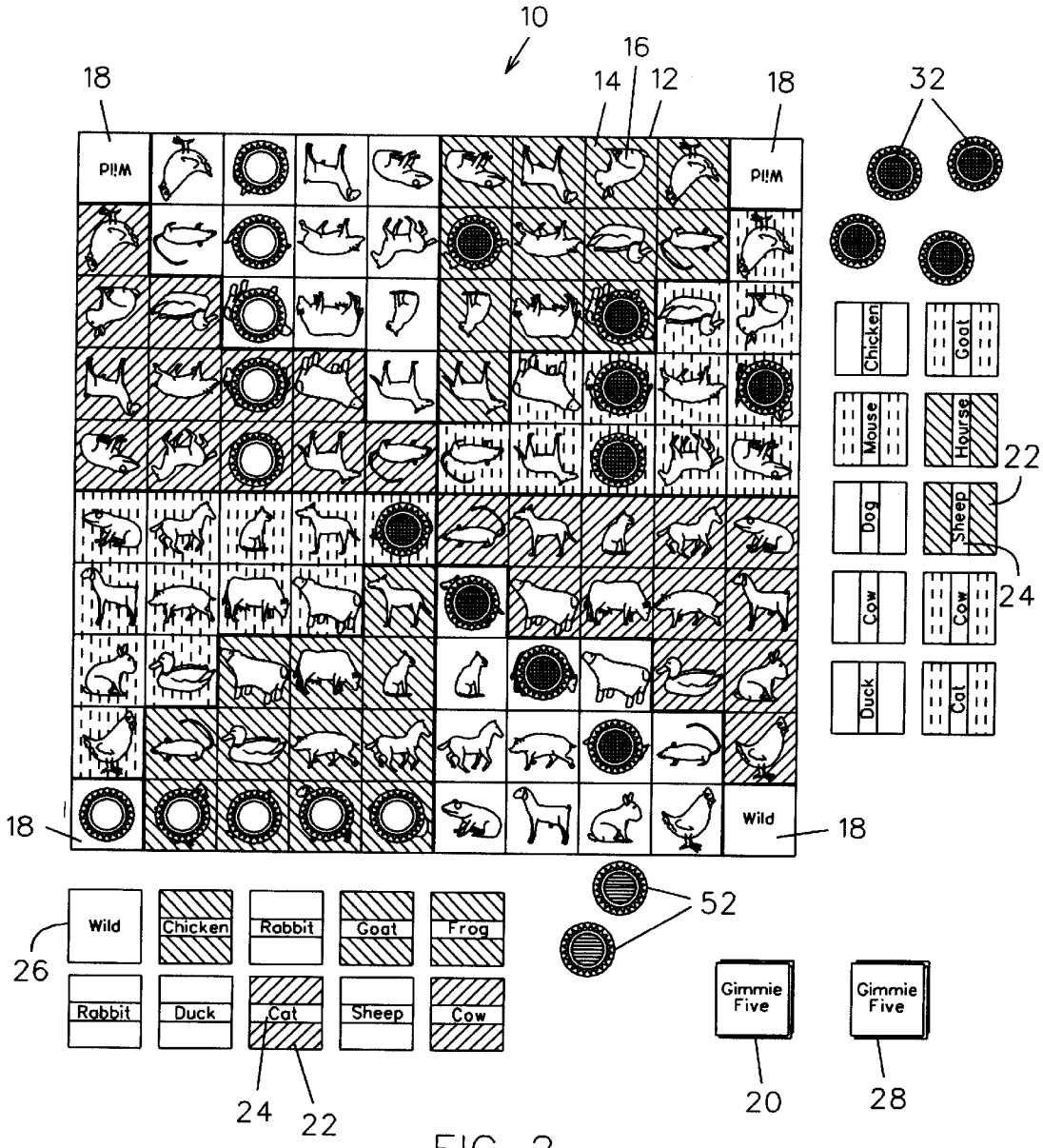
FIG. 2 is a top view of the components of the present board game apparatus according to the preferred embodiment of the invention.

A preferred embodiment of an educational board game method and apparatus will now be described with reference to FIGS. 1–3 of the accompanying drawings. The board game includes a rectangular game board 10 having one hundred rectangular spaces 12 of identical dimension and size area. The four corner spaces 18 are designated as "wild" (free) spaces. Each space 12, except for the wild spaces, includes at least two types of indicia, preferably color 14 and pictorial 16 indicia. Presenting four different colors and twelve different illustrations, the game board 10 is organized such that only two spaces include the same combination of color and pictorial indicia. The color indicia are solid color backgrounds although color patterns would also be suitable. The pictorial indicia are illustrations of easily recognizable animals although illustrations of other objects would also be suitable. Spaces 12 having a same color indicia are adjacent one another on each half of the game board 10.

The board game further includes two decks of game cards 20, 28, each deck including fifty cards with the cards of the second deck 28 being identical to the cards of the first deck 20. Each card also includes at least two types of indicia. In the preferred embodiment, each card includes color indicia 22 and alphabetic indicia 24. The color indicia 22 of a particular card matches one of the four different colors of said spaces 12. The alphabetic indicia 24 of a card is the name of one of the twelve illustrations of said spaces. Therefore, the combination of color and alphabetic indicia of a card of the first 20 or second 28 deck of cards is associated with the combination of color and pictorial indicia of two spaces 12 on the game board 10. Therefore, a player must associate the color 22 and name 24 found on a card with the color 14 and illustration 16 of the corresponding space. Two cards in each deck 20, 28 are designated as "wild cards" 26.

Figure 3A:
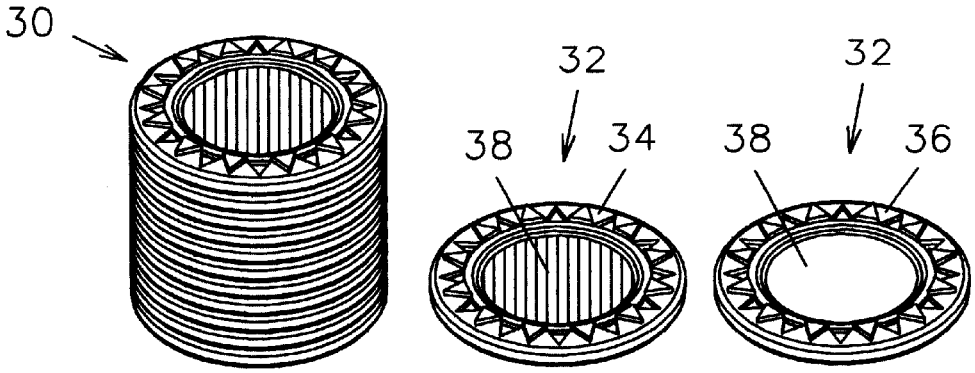
FIG. 3A is a perspective view of a first distinct set of tokens.
Figure 3B:
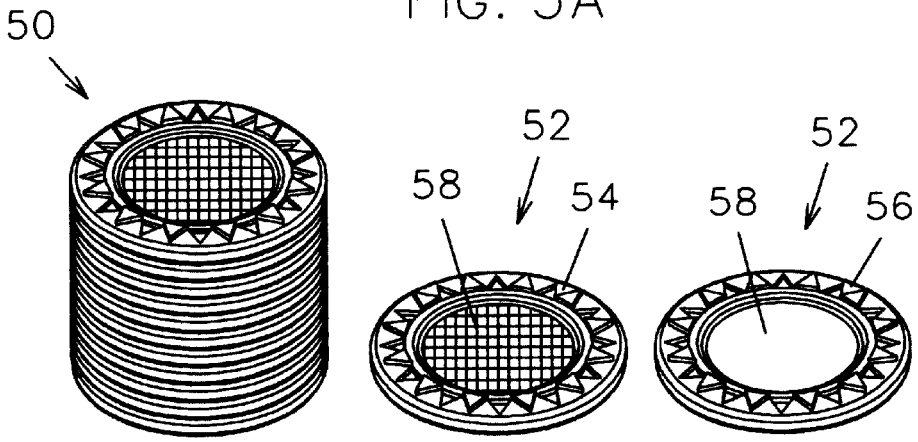
FIG. 3B is a perspective view of a second distinct set of tokens.
Figure 3C:
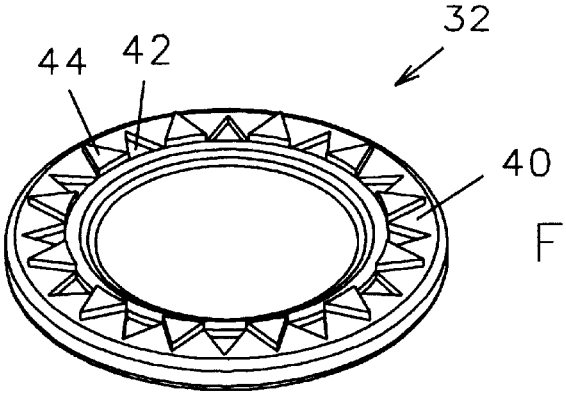
FIG. 3C is a perspective view on an enlarged scale of a token.

As shown in FIGS. 3A–3C, the board game further includes first 30 and second 50 distinct sets of tokens. Each token 32 of the first set 30 presents a disk-like configuration having top 34 and bottom 36 sides. Each side 34, 36 includes a concave or recessed center portion 38 bounded by a planar outer rim 40. Each rim 40 includes a plurality of spaced apart triangular notches 42 and a plurality of triangular flanges 44 intermediate adjacent notches 42. These notch/flange combinations are configured to mate with notch/flange combinations of another token 32 such that the tokens 32 may be stacked one atop another. The center portion 38 of the top side 34 of each token 32 of the first set 30 presents a first color, e.g. red, whereas the bottom side thereof presents a second color, e.g. white. Tokens 52 of the second set 50 of tokens are constructed substantially similar to tokens of the first set 30 except that the center portion 58 of the top side 54 of each token 52 presents a color different from that of the top side of a token 32 of the first set 30, e.g. blue. Further, the center portion 58 of the bottom side 56 of each token 52 of the second set 50 presents a color different than the color of the top side thereof, e.g. white. The different colors of the top sides of tokens of first and second sets is useful to distinguish which team of players are associated therewith, as to be more fully described below. Alternatively, sets of tokens having a completely colored construction can be used for this distinctive purpose.

According to the preferred method of play, a plurality of players are divided into two teams. Tokens are distributed to each team according to the color to be associated therewith or by placing them top side up so as to display their distinctive color. Next, at least one card from each deck having the same combination of color 22 and alphabetic 24 indicia are designated as "special wild cards". Next, the first 20 and second 28 decks of cards are shuffled together into a single deck and five cards are dealt to each player. The single deck is then again divided evenly into two decks and placed adjacent the game board 10 for use as draw piles. A first player then discards one of his cards by placing it face up adjacent the game board 10. The first player must then associate the color 22 and alphabetic 24 indicia of the discarded card with a space 12 on the game board having corresponding color 14 and pictorial indicia 16. The player then positions a token on that space.

Instead of playing a card having color and alphabetic indicia, the player may play a wild card or special wild card if he has one in his hand. Playing a wild card allows the player to place a token on any space 12 on the game board 10 not already having a token placed thereon. Playing a special wild card allows the player to remove another player's token from the game board 10. If a player does not desire to make any of the above described plays, he may place a token on any of the free spaces 18. If a player has discarded a card as described above, the player may draw an additional card from one of the two decks of remaining cards. However, if the player does not draw a replacement card before the next player makes a play, the first player forfeits the right to draw a replacement card and must continue with fewer cards.

Play continues in the above described manner until one player or player team has positioned one or two sets of five tokens on adjacent horizontal, vertical, or diagonal spaces 12 of the game board 10 or on four adjacent spaces 12 and an adjacent free space 12. When a set of five tokens has been properly positioned and the game is to continue for a second set of five tokens, an additional token of a different color is stacked atop each token of the first set to indicate that those tokens cannot be removed by a special wild card. The team having positioned two sets of five tokens as described above is declared the winner.

A first alternative embodiment of this invention includes a game board 10 and sets of tokens 30, 50 as described above. The cards, however, include color indicia and pictorial indicia which match the color and pictorial indicia of respective spaces 12 of the game board 10. The method of play remains the same.

Figure 4:
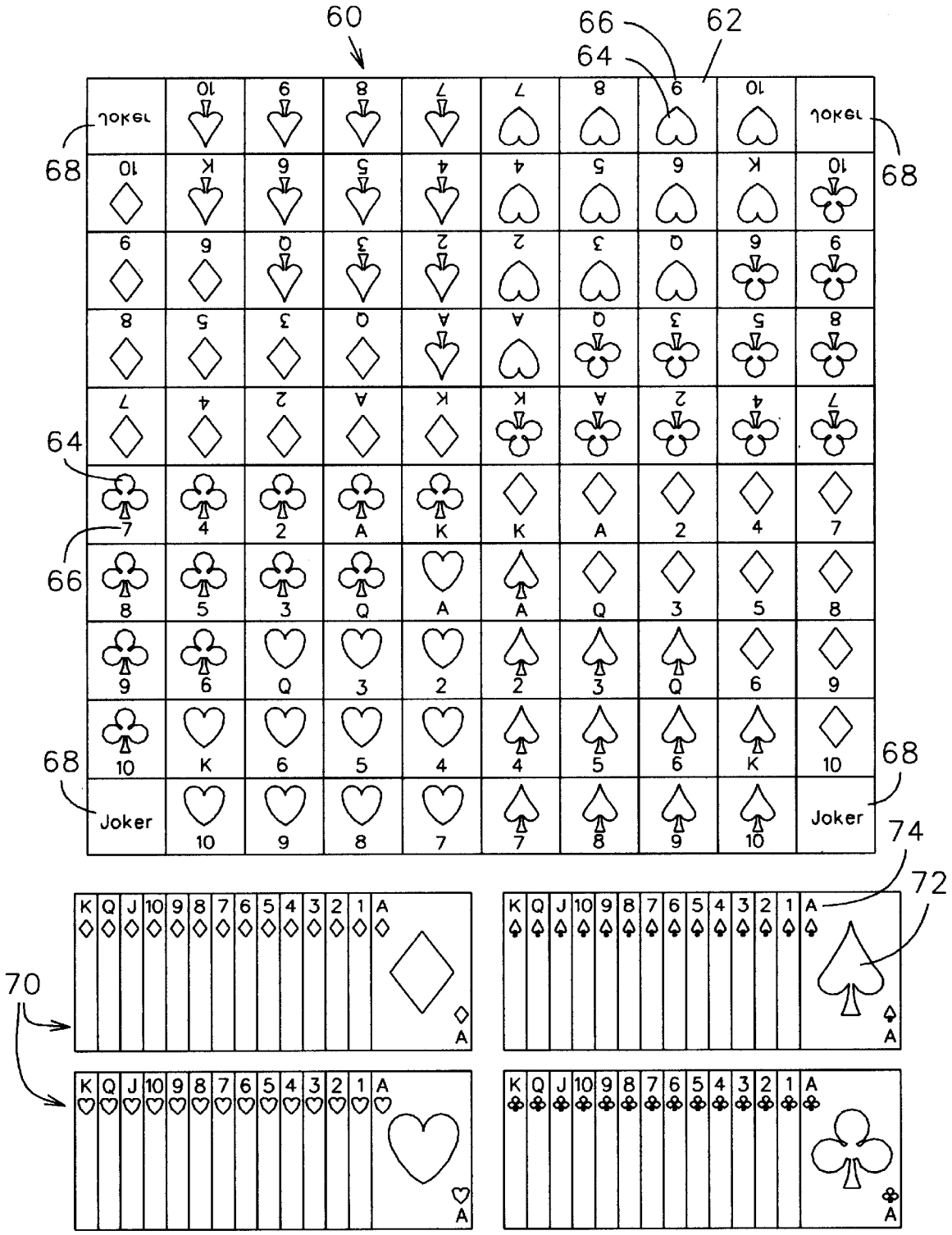
FIG. 4 is a top view of an alternative embodiment of the game board and cards of the present invention.

As shown in FIG. 4, a second alternative embodiment of this invention includes a rectangular game board 60 having one hundred rectangular spaces 62 of equal dimension, two each of the spaces 62 having the same traditional playing card suit 64 and denomination indicia 66. The game board 60 further includes four corner free spaces 68 designated by the word "Joker". This embodiment includes first 70 and second (not shown) decks of traditional playing cards having conventional suit 72 and denomination 74 indicia thereon. The method of game play is substantially similar to that described above except that two-eyed Jacks function as wild cards and one-eyed Jacks function as super wild cards.

It should also be appreciated that traditional playing card indicia, pictorial indicia, and color indicia can be simultaneously presented on the spaces of a game board and cards of both card decks such that appropriate game play is possible by persons of any age without the necessity of separate game components.

It is understood that while certain forms of this invention have been illustrated and described, it is not limited thereto except insofar as such limitations are included in the following claims and allowable functional equivalents thereof.

What is claimed is:

1. A board game apparatus, comprising:

a rectangular game board having one hundred rectangular spaces of equal dimension, two each of said spaces having a combination of first and second indicia different than a combination of first and second indicia of any other of said spaces, four of said spaces being designated as wild spaces;

a first deck of fifty cards, each card having first and second indicia indicative of said combination of first and second indicia of two of said spaces of said game board, except that two cards of said first deck are wild cards, said second indicia of said cards being nonidentical but related to said second indicia of said game board;

a second deck of fifty cards one each of which is identical to one of said cards in said first deck of cards;

a plurality of tokens for positioning upon individual spaces of said game board in association with said first and second indicia of a card selected from said first or second deck of cards;

said plurality of disk-shaped tokens including a first group of said tokens having a first color on a top side thereof and a second color on a bottom side thereof different from said first color and a second group of said tokens having a third color on a top side thereof different from said first and second colors and a fourth color on a bottom side thereof different from said third color; and wherein respective top and bottom sides of said plurality of tokens include a recessed center portion bounded by a planar rim surface, each said rim surface having a plurality of triangular flange/notch combinations extending radially about said rim such that said tokens are stackable atop one another.

2. A board game apparatus as in claim 1 wherein:

said second indicia of each said space includes pictorial indicia comprising illustrations of easily recognizable animals;

said first indicia of each said space includes color indicia;

said first indicia of each said card of said first deck of cards includes color indicia matching said color indicia of respective said spaces; and said second indicia of each said card of said first deck of cards includes alphabetic indicia, said alphabetic indicia being the names associated with said pictorial indicia of respective said spaces, said first and second indicia of each said card together being associated with said color and pictorial indicia of two of said spaces of said game board.

3. A board game apparatus as in claim 1 wherein:

said second indicia of each said space includes pictorial indicia comprising illustrations of easily recognizable animals;

said first indicia of each said space includes color indicia;

said first indicia of each said card of said first deck of cards includes color indicia matching said color indicia of respective said spaces; and said second indicia of each said card of said first deck of cards includes illustrations of easily recognizable animals matching said pictorial indicia of respective said spaces, said first and second indicia of each said card together matching said color and pictorial indicia of two of said spaces of said game board.

4. A method of playing a board game, comprising the steps of:

providing a rectangular game board, said game board divided into one hundred rectangular spaces of equal dimension, two each of said spaces including first and second indicia different from the indicia of any other of said spaces, except for four corner spaces designated with indicia as wild spaces;

providing a first deck of fifty cards, each card having a first indicia and a second indicia indicative of said first and second indicia of two of said spaces of said game board, except for two cards having indicia indicative of wild cards, said second indicia of said cards being nonidentical but related to said second indicia of said game board;

providing a second deck of fifty cards one each of which is identical to one of said cards in said first deck;

providing a plurality of tokens for positioning upon said spaces, a first group of said tokens having a first color on a top side thereof and a second color on a bottom side thereof different from said first color and a second group of said tokens having a third color on a top side thereof different from said first and second colors and a fourth color on a bottom side thereof different from said third color;

designating a predetermined number of cards of said first and second decks of cards having a selected first and second indicia as special wild cards;

shuffling said first and second decks of cards into a single deck of cards before beginning game play;

distributing a portion of said combined deck of cards evenly among a group of players, said group of players forming a pair of player teams;

dividing said single deck of cards into two decks after said step of distributing a portion of said combined deck of cards among said group of players;

an initial player discarding one of said cards and positioning a token upon a space on said game board having indicia indicated by said discarded card, said token positioned so as to display a color indicative of the player or player team with which said initial player is associated;

said initial player then drawing a card from an undistributed portion of one of said two divided decks of cards, a failure to draw a card before a next player performs a game action resulting in said initial player forfeiting said draw;

allowing any player discarding one of said wild cards to position a token upon any space on said game board not previously covered by another token;

allowing any player discarding one of said special wild cards to remove a selected token from said game board;

continuing play in the above manner in sequential order among said players until one of said players or player teams is first to position said tokens horizontally, vertically, or diagonally on a first set of five adjacent of said spaces or four adjacent of said spaces and an adjacent wild space and a second set of five adjacent of said spaces or four adjacent of said spaces and an adjacent wild space, and thereby win the game; and positioning another token associated with a respective player or group of players bottom side up upon each token associated with a respective player or group of players previously positioned upon said first set of five adjacent of said spaces or four adjacent of said spaces and an adjacent one of said free spaces.

5. A method of playing a board game as in claim 4 wherein said first indicia of said spaces is color indicia and said second indicia of said spaces is pictorial indicia.

6. A method of playing a board game as in claim 5 wherein said first indicia on said cards of said first deck is color indicia and said second indicia on said cards of said first deck is pictorial indicia, said pictorial indicia of said cards of said first deck being identical to said pictorial indicia of respective said spaces of said game board.

7. A method of playing a board game as in claim 5 wherein said first indicia of said cards of said first deck is color indicia and said second indicia of said cards of said first deck is alphabetic indicia, said alphabetic indicia being the names of said pictorial indicia of respective said spaces.

8. A method of playing a board game as in claim 4, wherein said first deck of cards is a standard deck of playing cards, said first indicia of each card being pictorial indicia indicative of a playing card suit and said second indicia of each card being a numerical indicia indicative of a particular member of said suit.

9. A method of playing a board game as in claim 8, wherein said wild cards are two-eyed Jacks and said special wild cards are one-eyed Jacks.

* * * * *